US009169702B2

(12) United States Patent
Bowley et al.

(10) Patent No.: US 9,169,702 B2
(45) Date of Patent: Oct. 27, 2015

(54) TOP DRIVE POWERED DIFFERENTIAL SPEED ROTATION SYSTEM AND METHOD

(71) Applicant: TESCO CORPORATION, Houston, TX (US)

(72) Inventors: Ryan Thomas Bowley, Calgary (CA); Edgar Fernando Yajure, Calgary (CA)

(73) Assignee: TESCO CORPORATION, Houston, TX (US)

( * ) Notice: Subject to any disclaimer, the term of this patent is extended or adjusted under 35 U.S.C. 154(b) by 282 days.

(21) Appl. No.: 13/664,242

(22) Filed: Oct. 30, 2012

(65) Prior Publication Data

US 2014/0121048 A1 May 1, 2014

(51) Int. Cl.
*E21B 19/16* (2006.01)

(52) U.S. Cl.
CPC ..... *E21B 19/168* (2013.01); *Y10T 74/19* (2015.01); *Y10T 74/19637* (2015.01)

(58) Field of Classification Search
CPC ..... E21B 19/16; E21B 19/168
See application file for complete search history.

(56) References Cited

U.S. PATENT DOCUMENTS

| | | | | |
|---|---|---|---|---|
| 5,255,751 | A * | 10/1993 | Stogner | 175/203 |
| 5,645,131 | A * | 7/1997 | Trevisani | 175/171 |
| 6,352,129 | B1 * | 3/2002 | Best | 175/25 |
| 6,435,280 | B1 | 8/2002 | Van Wechem et al. | |
| 6,591,916 | B1 * | 7/2003 | Ayling | 166/380 |
| 2002/0157823 | A1 | 10/2002 | Pietras et al. | |
| 2007/0051508 | A1 * | 3/2007 | Pecorari et al. | 166/68.5 |
| 2013/0153244 | A1 * | 6/2013 | Nikiforuk | 166/380 |
| 2014/0124267 | A1 * | 5/2014 | Ayling | 175/40 |

OTHER PUBLICATIONS

International Search Report & Written Opinion for International Application No. PCT/US2013/065376 mailed Mar. 25, 2015.

* cited by examiner

*Primary Examiner* — William P Neuder
(74) *Attorney, Agent, or Firm* — Fletcher Yoder, P.C.

(57) ABSTRACT

Certain embodiments include a system having a first grip configured to couple to a first tubular, a second grip configured to couple to a second tubular, where the first and second tubulars are connected by a threaded connection, and a gear assembly coupling the first and second grips, wherein the gear assembly has a speed ratio greater than 1.

17 Claims, 7 Drawing Sheets

TOP DRIVE POWERED DIFFERENTIAL SPEED ROTATION SYSTEM AND METHOD

BACKGROUND

Embodiments of the present disclosure relate generally to the field of drilling and processing of wells. More particularly, present embodiments relate to a system and method for connecting or disconnecting sections of tubular.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling. The drill string may include multiple sections of tubular that are coupled to one another by threaded connections or joints. In traditional operations, the sections of tubular are coupled together and decoupled from one another using hydraulic tongs.

BRIEF DESCRIPTION

In a first embodiment, a system includes a first grip configured to couple to a first tubular, a second grip configured to couple to a second tubular, where the first and second tubulars are connected by a threaded connection, and a coupling mechanism coupling the first and second grips, wherein the coupling mechanism has a speed ratio greater than 1.

In a second embodiment, a system includes a joint rotation system. The a joint rotation system includes a first clamping mechanism configured to clamp to a first pipe, a second clamping mechanism configured to clamp to a second pipe, wherein the first and second pipes are coupled by a threaded connection, a first gear configured to be driven by rotation of the first clamping mechanism, and a second gear fixedly attached to the first gear, wherein a speed ratio of the first and second gears is greater than one, and the second gear is configured to drive rotation of the second clamping mechanism.

In a third embodiment, a method includes rotating a first tubular at a first angular velocity with a top drive and rotating a second tubular at a second angular velocity, wherein the first tubular is coupled to the second tubular by a threaded joint, and the second angular velocity is greater than the first angular velocity.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
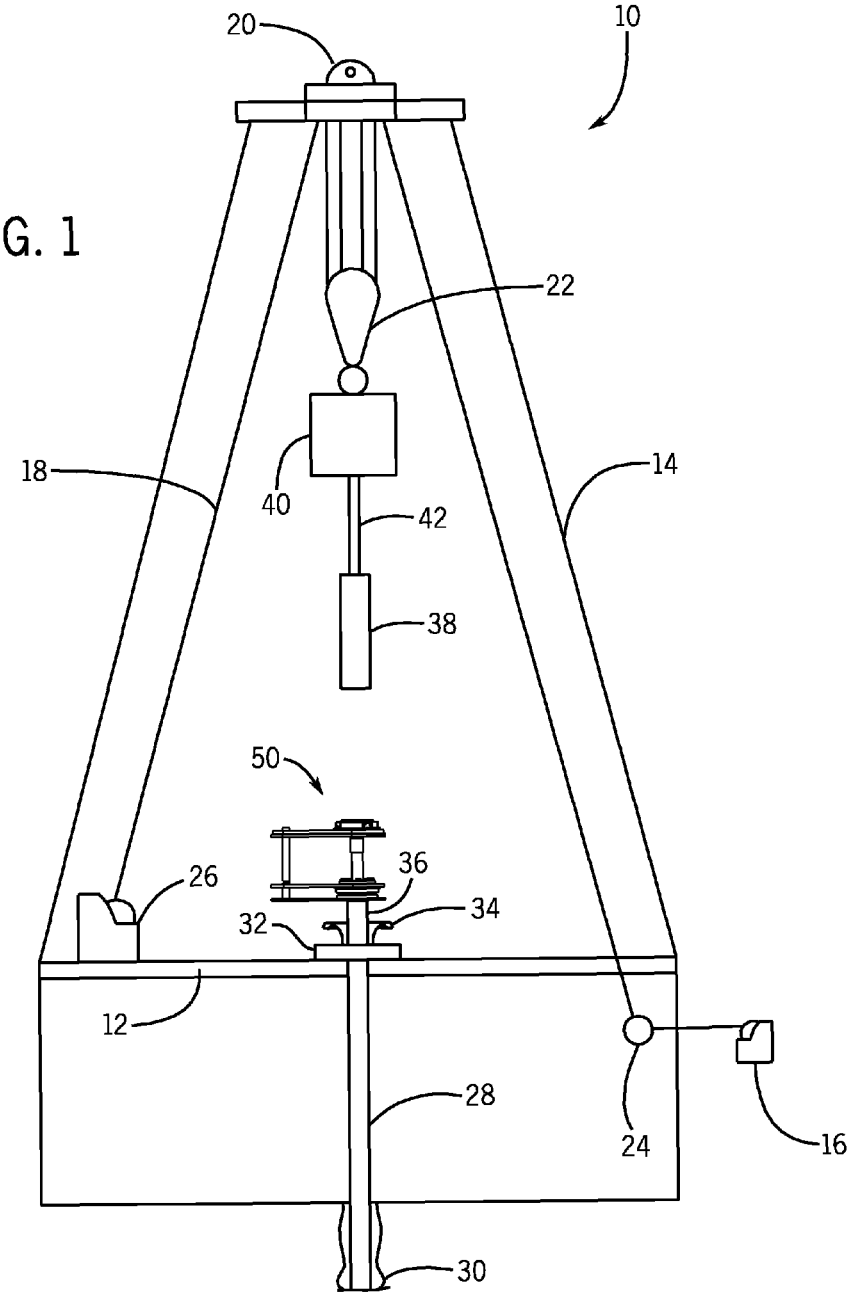
FIG. 1 is a schematic of a well, in accordance with present techniques.

FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. During operation, a top drive 40, hoisted by the traveling block 22, may engage and position the tubular 38 above the wellbore 30. The top drive 40 may then lower the coupled tubular 38 into engagement with the stump 36 and rotate the tubular 38 such that it connects with the stump 36 and becomes part of the drill string 28. Specifically, the top drive 40 includes a quill 42 used to turn the tubular 38 or other drilling equipment. Also, during other phases of operation of the drilling rig 10, the top drive 40 may be utilized to disconnect and remove sections of the tubular 38 from the drill string 28, as is illustrated in FIG. 1.

The drill string 28 may include multiple sections or joints of threaded tubular 38 that are threadably coupled together using techniques in accordance with present embodiments. It should be noted that present embodiment may be utilized with drill pipe, casing, or other types of tubular. After setting or landing the drill string 28 in place such that the male threads of one section (e.g., one or more joints) of the tubular 38 and the female threads of another section of the tubular 38 are engaged, the two sections of the tubular 38 may be joined by rotating one section relative to the other section (e.g., in a clockwise direction) such that the threaded portions tighten together. Thus, the two sections of tubular 38 may be threadably joined. Furthermore, as the drill string 28 is removed from the wellbore 30, the sections of the tubular 38 may be detached by disengaging the corresponding male and female threads of the respective sections of the tubular 38 via relative rotation of the two sections in a direction opposite than used for coupling. In accordance with presently disclosed embodiments, a joint rotation system 50 may be used to decouple multiple sections of the threaded tubular 38 as the drill string 28 is removed from the wellbore 30. More specifically, in the manner described below, the top drive 40 and the joint rotation system 50 are used to rotate two sections of tubular 38 coupled to one another at different speeds such that the relative rotations result in disengagement of the two sections of the tubular 38. Indeed, the joint rotation system 50 is geared (or coupled together and driven at a ratio) to facilitate rotation of the two sections of tubular 38 at different speeds, thereby breaking or disconnecting the threaded coupling between the two sections of tubular 38.

It should be noted that the illustration of FIG. 1 is intentionally simplified to focus on the top drive 40 and the joint rotation system 50. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
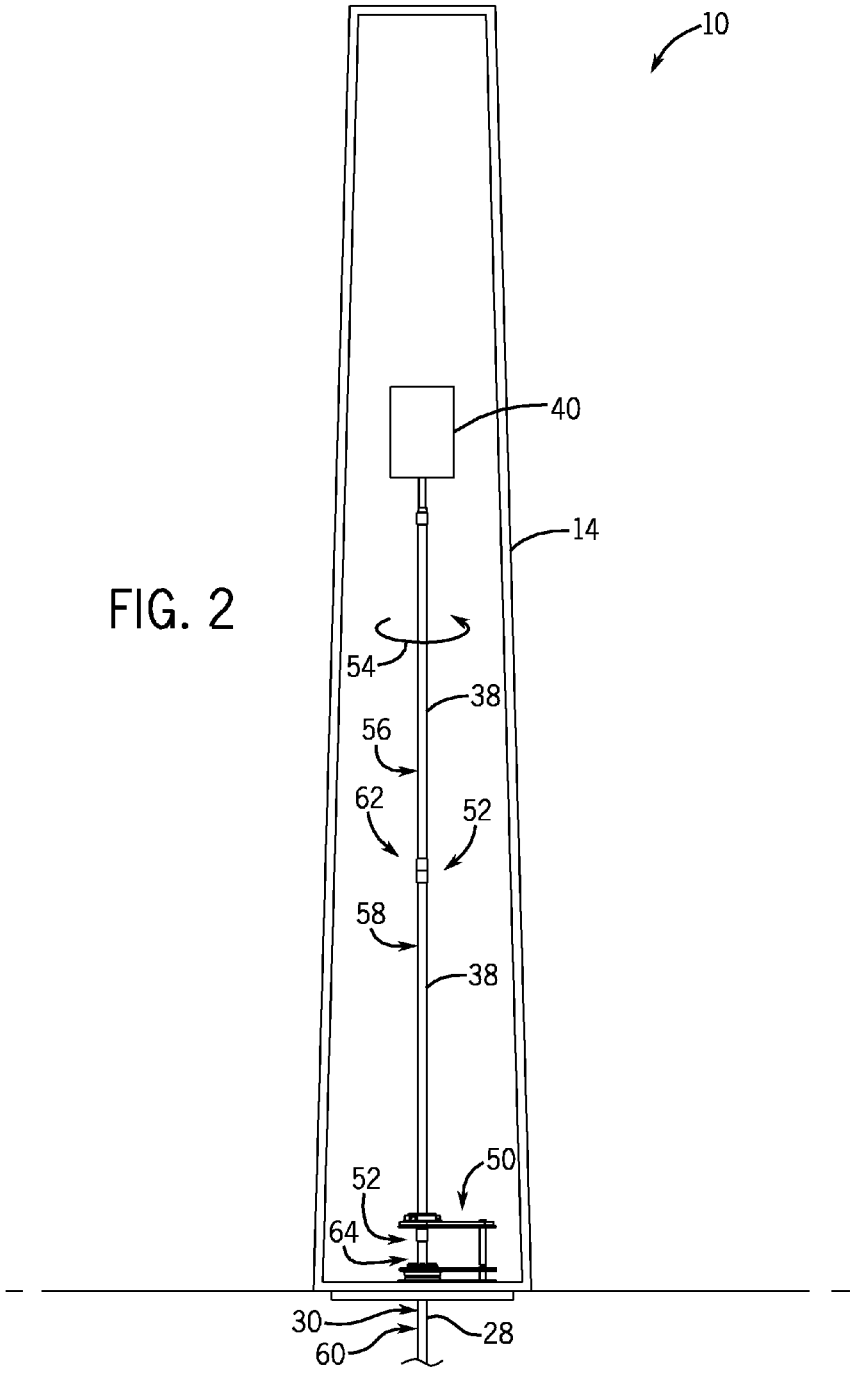
FIG. 2 is a schematic of a well, illustrating a joint rotation system, in accordance with present techniques.

FIG. 2 is a simplified schematic of a portion of the drilling rig 10, illustrating the joint rotation system 50 for use in coupling, joining, breaking, or disconnecting threaded couplings between sections of tubular 38. In this illustrated embodiment, the drill string 28 is in the process of being removed from the wellbore 30. Specifically, multiple joints of tubular 38, which are threadably connected to one another at tool joints 52, are being removed from the wellbore 30. As such, the multiple sections of tubular 38 are rotated in the same direction but at different speeds relative to one another using the top drive 40 and the joint rotation system 50 in order to disconnect the tool joints 52. Due to the different speeds of rotation, when disconnecting two sections of tubular 38, one section of tubular 38 may essentially be rotated counterclockwise (e.g., in a direction 54) relative a second section of tubular 38, thereby disconnecting the tool joints 52 of the two sections of tubular 38. In other words, although both sections of tubular 38 are being rotated in the same direction, because one is being rotated faster than the other, the section rotating faster is rotating in the direction 54 relative to the section being rotated slower.

When the drill string 28 is removed from the wellbore 30, it may be desirable to disconnect sections of tubular 38 that include multiple joints. In other words, several joints of tubular 38 may be left connected by the tool joints 52 when the drill string 28 is removed from the wellbore 30 in sections. For example, it may be desirable to remove sections of tubular that each includes two or three joints of tubular that remain coupled together and thus limit trip times. The length of each section of tubular kept in tact (not decoupled at every joint) may be limited by the rig height. For example, when removing the drill string 28 from the wellbore 30, every second, third, or fourth tool joint 52 may be broken or disconnected depending on joint lengths and the height of the drilling rig 10. In this manner, sections of tubular 38 including multiple joints that remain connected may be set aside for later use with the drilling rig 10. As will be appreciated, this practice may result in faster re-assembly of the drill string 28, when the drill string 28 is assembled for use within the wellbore 30 at a later time.

To enable the disassembly of certain tool joints 52 when the drill string 28 is removed from the wellbore 30, the joint rotation system 50 may be used. As mentioned above, the joint rotation system 50 is geared (or coupled together or driven at a ratio) to rotate two sections or joints of tubular 38 at different speeds while the top drive 40 rotates the drill string 28. Three joints of tubular 38 are shown in FIG. 2 (e.g., a first joint 56, a second joint 58, and a third joint 60). Additionally, the first and second joints 56 and 58 are joined by a first threaded connection 62 (e.g., a tool joint connection), and the second and third joints 58 and 60 are joined by a second threaded connection 64 (e.g., a tool joint connection).

In the illustrated embodiment, the joint rotation system 50 is positioned to disconnect the second threaded connection 64 as the three joints 56, 58, and 60 of tubular 38 are rotated by the top drive 40, while maintaining the connection of the first threaded connection 62. In particular, as the top drive 40 rotates the three joints 56, 58, and 60 of tubular 38 in the clockwise direction 54, the joint rotation system 50 creates a rotating speed differential between the second and third joints 58 and 60 of tubular, thereby breaking or disconnecting the second threaded connection 64. Specifically, as the three joints 56, 58, and 60 of tubular 38 are rotated in the clockwise direction 54, the joint rotation system 50 increases the rotational torque applied by the top drive 40 and applies the increased torque to the third joint 60 of tubular 38. In this manner, the third joint 60 of tubular 38 rotates in the clockwise direction 54 faster than the second joint 58 of tubular 38 rotates in the clockwise direction 54, thereby unthreading the second threaded connection 64 and decoupling the second and third joints 58 and 60 of tubular. Furthermore, as the first and second joints 56 and 58 of tubular 38 are both rotated in the clockwise direction 54 and at the same speed, the first threaded connection 62 may not be at risk of becoming disconnected or unthreaded.

Figure 3:
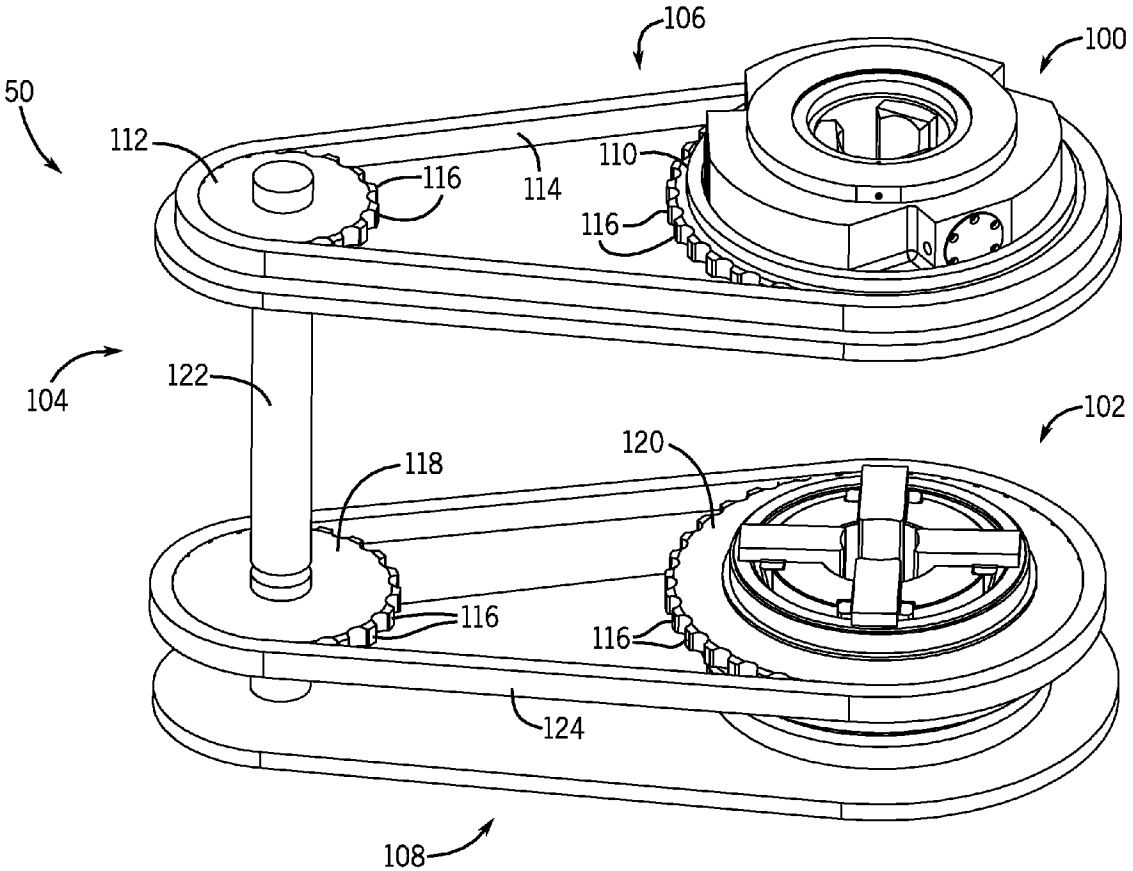
FIG. 3 is a perspective view of a joint rotation system, in accordance with present techniques.

FIG. 3 is a perspective view of an embodiment of the joint rotation system 50. In the illustrated embodiment, joint rotation system 50 includes a first clamping mechanism 100 and a second clamping mechanism 102, which are coupled together by a gear assembly 104 (e.g., a sprocket assembly). While the illustrated embodiment describes the gear assembly 104, other embodiments may have any coupling assembly that couples (e.g., mechanically couples) the first clamping mechanism 100 and the second clamping mechanism 102 (e.g., at a drive ratio greater than one). For example, the coupling assembly may include hydraulic motors of different volume ratios, belts and pulleys, mechanical levers, and so forth. The first and second clamping mechanisms 100 and 102 are configured to fixedly couple to respective joints of tubular 38 that are joined to one another by the tool joints 52 (e.g., a threaded connection). For example, the first clamping mechanism 100 may fixedly couple the second joint 58 of tubular 38 shown in FIG. 2, and the second clamping mechanism 102 may couple to the third joint 60 of tubular 38 shown in FIG. 2. In other words, the first clamping mechanism 100 couples to the top tubular 38 of the tool joints 52, and the second clamping mechanism 102 couples to the bottom tubular 38 of the tool joints 52. As such, the joint rotation system 50 would operate to disengage the second threaded connection 64. Additionally, the first clamping mechanisms 100 and the second clamping mechanism 102 may operated separately or independently. The clamping mechanisms 100 and 102 may include various grips, braces, or other systems configured to secure the joint rotation system 50 to the joints of tubular 38. For example, the illustrated clamping mechanisms 100 and 102 are hydraulic clamps. As discussed below with respect to FIGS. 4 and 5, the clamping mechanisms 100 and 102 may include belts, knurled rollers, or other systems configured to grip the respective joints of tubular 38. Additionally, the second clamping mechanism 102 (e.g., the clamping mechanism which couples to the bottom tubular 38) may also be similar to a power slip. In other words, the second clamping mechanism 102 may be configured to support the weight and torque of the drill string 28. Additionally, in such an embodiment, the second clamping mechanism 102 may have a rotational locking mechanism.

As mentioned above, the first and second clamping mechanisms 100 and 102 are joined by the gear assembly 104. It should be appreciated that the gear assembly 104 described below may also be a sprocket assembly having sprockets. The gear assembly 104 is configured to increase the rotational speed generated by the top drive 40 and apply the increased rotational speed to one of the joints of tubular 38 (e.g., the lower of the two joints of tubular 38) joined by the tool joints 52. For example, referring back to FIG. 2, the joint rotation system 50 is configured to increase the rotational speed of the third joint 60 of tubular 38 relative to the rotational speed of the second joint 58 of tubular 38. In this manner, the second threaded connection 64 would be broken, and the second and third joints 58 and 60 would decouple from one another.

As shown, the gear assembly 104 (e.g., sprocket assembly) includes a top portion 106 and a bottom portion 108. The top portion 106 includes a first gear 110 (e.g., a first sprocket), which is coupled to the first clamping mechanism 100, and a second gear 112 (e.g., a second sprocket), which is chain-driven by the first gear 110. That is, a chain 114 mechanically couples the first gear 110 and the second gear 112. Therefore, as the joint of tubular 38 clamped by the first clamping mechanism 100 rotates, the first clamping mechanism 100 will rotate, and the chain 114 will drive rotation of the second gear 112. Moreover, the second gear 112 is smaller and has fewer teeth 116 than the first gear 110. Consequently, the second gear 112 will rotate faster than the first gear 110. In certain embodiments, the gear ratio between the first and second gears 110 and 112 may be between approximately 2:1 to 3:1.

The bottom portion 108 of the gear assembly 104 includes a third gear 118 (e.g., a third sprocket) and a fourth gear 120 (e.g., a fourth sprocket). Additionally, the third gear 118 of the bottom portion 108 is fixedly coupled to the second gear 112 of the top portion 106 by a rod 122. As such, the second gear 112 of the top portion 106 will rotate at the same speed as the third gear 118 of the bottom portion 108. However, the second gear 112 and the third gear 118 are not the same size. In particular, the second gear 112 is smaller and has fewer teeth 116 than the third gear 118.

Furthermore, in operation, the fourth gear 120 is chain-driven by the third gear 118. That is, a chain 124 mechanically couples the third gear 118 and the fourth gear 120. Therefore, as the third gear 118 rotates, the chain 124 will drive rotation of the fourth gear 120, and therefore the second clamping mechanism 102. In this manner, the joint of tubular 38 clamped by the second clamping mechanism 102 will rotate. Furthermore, as discussed below, the first and fourth gears 110 and 120 may be substantially the same size and have substantially the same number of teeth 116.

Figure 4:
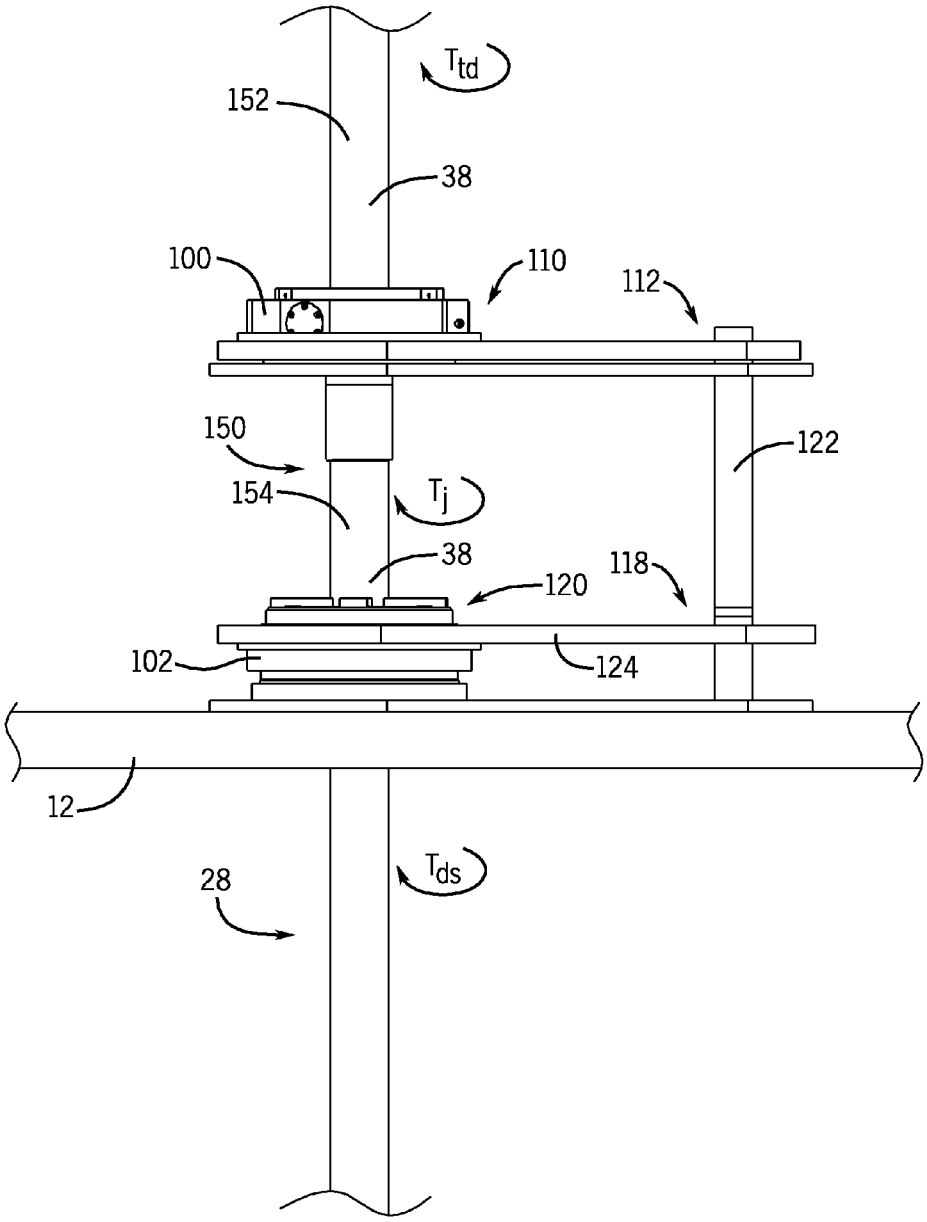
FIG. 4 is a side view of a joint rotation system, in accordance with present techniques.

FIG. 4 is a side view of the joint rotation system 50 shown in FIG. 3, illustrating operation of the joint rotation system 50. Specifically, in the illustrated embodiment, the joint rotation system 50 is breaking or unthreading a threaded connection 150 (e.g., a connection between two tool joints 52), which couples a first joint 152 of tubular 38 (e.g., a top joint) and a second joint 154 of tubular 38 (e.g., a bottom joint).

As will be appreciated by one skilled in the art, the torque applied to the first joint 152 by the top drive 40 may be expressed as $$T_{td} = \frac{A/B}{C/D} \times T_{ds} + \left(1 - \frac{\frac{A}{B}}{\frac{C}{D}}\right) T_j \tag{1}$$

where A/B is the gear ratio between the first gear 110 and the second gear 112, C/D is the gear ration between the fourth gear 120 and the third gear 118, $T_{td}$ is the torque acting on the first joint 152, $T_{ds}$ is the torque acting on the second joint 154 (e.g., the drill string 28), and $T_j$ is the torque acting on the threaded connection 150. As mentioned above, the first and fourth gears 110 and 120 may be approximately the same size and have approximately the same number of teeth. Therefore, Equation (1) may be expressed as $$T_{td} = \frac{D}{B} \times T_{ds} + \left(1 - \frac{D}{B}\right) \tag{2}$$

When breaking or unthreading the threaded connection 150, the torque acting on the second joint 154 (i.e., $T_{ds}$) may be approximately 0 as frictional torque will come once motion actually beings. As a result, the torque acting on the second joint 154 (i.e., $T_{ds}$) may not affect the top drive 40 output torque (i.e., $T_{td}$) during the initial breaking or unthreading of the threaded connection 150. Consequently, Equation (2) reduces to $$T_{td} = \left(1 - \frac{D}{B}\right) T_j \tag{3}$$

Similarly, once the threaded connection 150 begins to unthread and the threaded connection 150 torque (i.e., $T_j$) disappears, the top drive 40 may only experience the frictional torque, which may be expressed by $$T_{td} = \frac{D}{B} \times T_{ds} \tag{4}$$

As will be appreciated by one skilled in the art, D/B may be considered the overall drive or speed ratio of the gear assembly 104. Indeed, the drive or speed ratio may be greater than 1, thereby enabling faster rotation of the second joint 154 relative to the first joint 152, which results in the unthreading of the threaded connection 150. For example, in certain embodiments the gear or speed ratio of the gear assembly 104 may be between approximately 5:4 and 2:1.

Figure 5:
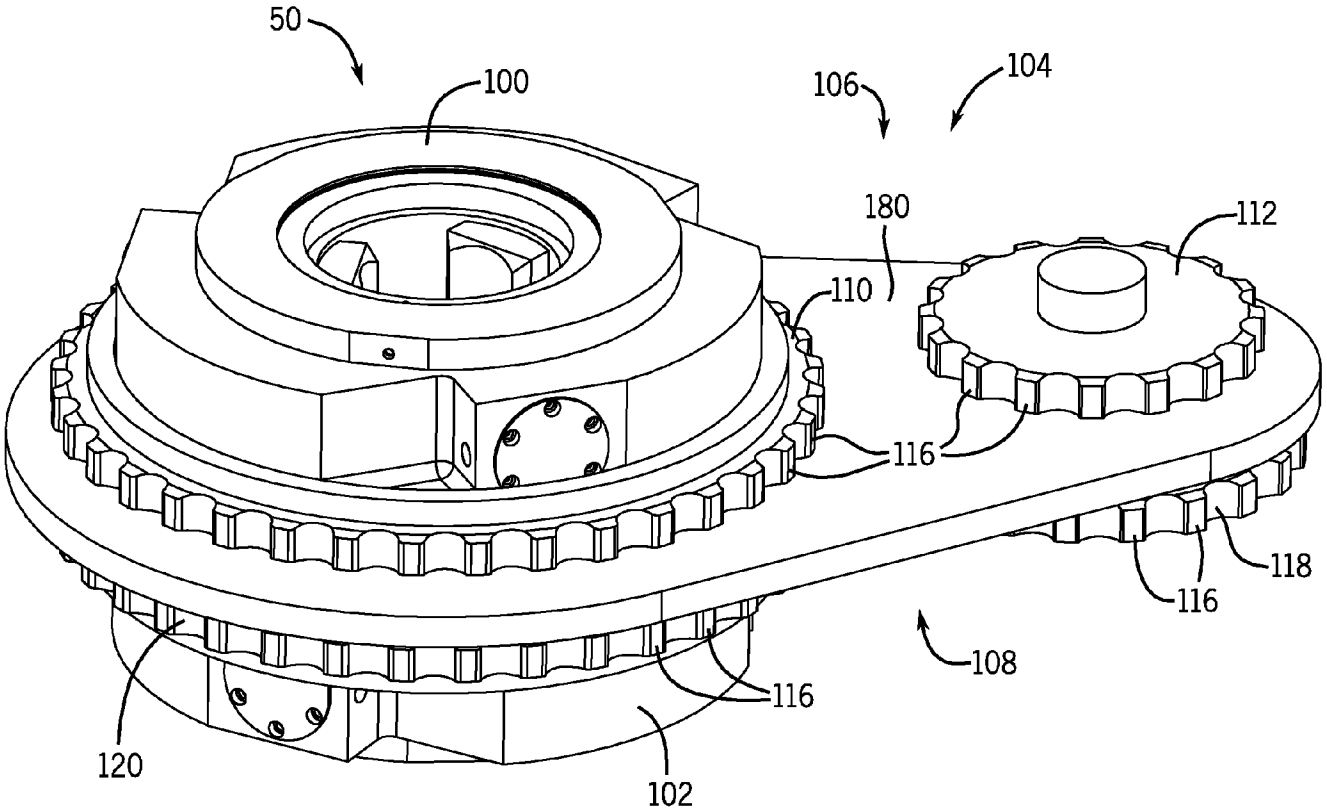
FIG. 5 is a perspective view of a joint rotation system, in accordance with present techniques.
Figure 6:
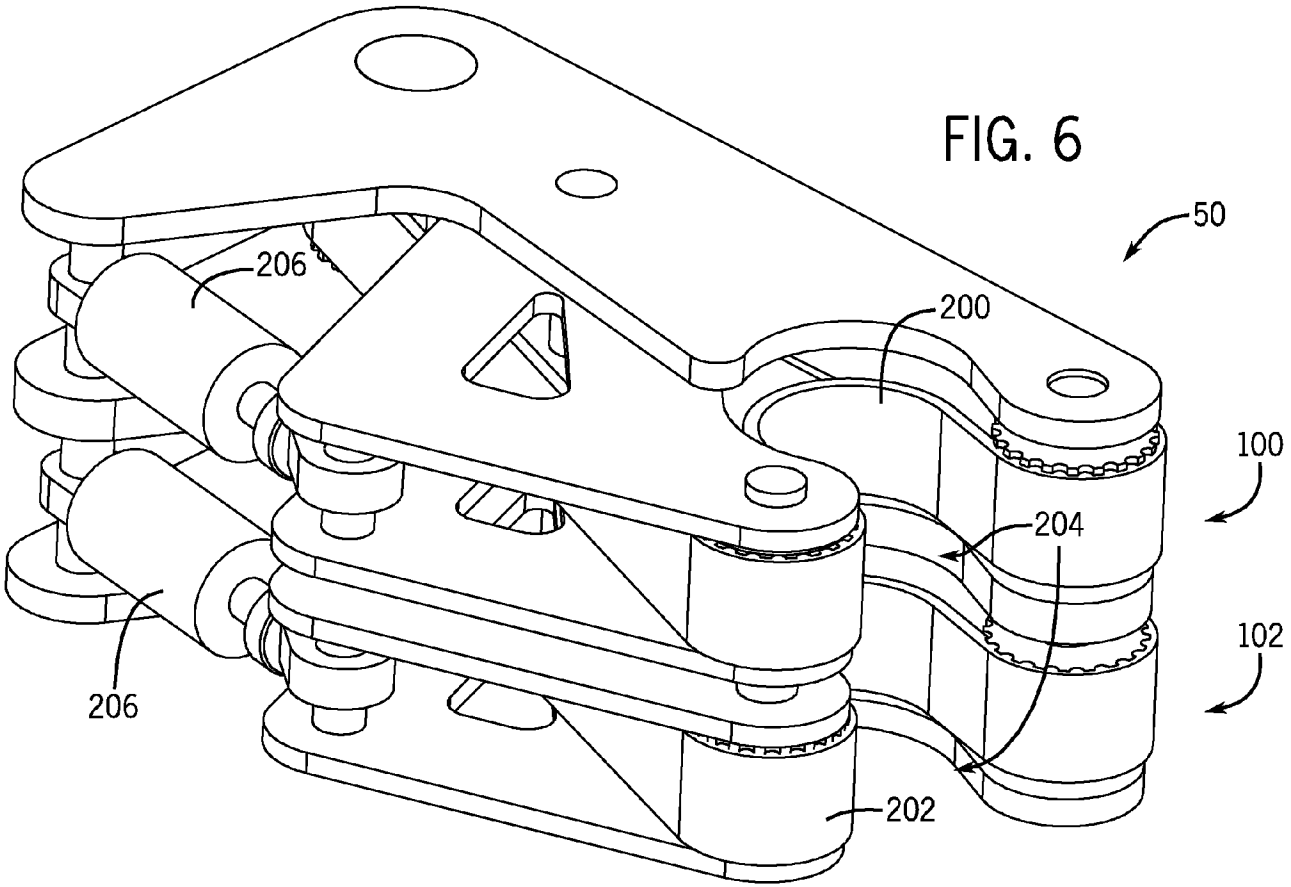
FIG. 6 is a perspective view of a joint rotation system, in accordance with present techniques.

FIGS. 5 and 6 are perspective views of embodiments of the joint rotation system 50. For example, FIG. 5 illustrates an embodiment of the joint rotation system 50 where the top and bottom portions 106 and 108 of the gear assembly 104 are disposed couple to opposite sides of a base plate 180. However, other components of the illustrated embodiment are similar to the embodiment shown in FIG. 3. For example, the first and second clamping mechanisms 100 and 102 are similar, and the various gears of the gear assembly 104 are similar. However, in the illustrated embodiment, the chains 114 and 124 have been omitted for clarity.

FIG. 6 is a perspective view of the joint rotation system 50 where the first and second clamping mechanisms 100 and 102 include belt or chain drive systems. Specifically, the first clamping mechanism 100 is a first belt (or chain) drive system 200, and the second clamping mechanism is a second belt (or chain) drive system 202. As shown, the first and second belt drive systems 200 and 202 have openings 204, which are configured to receive joints of tubular 38 on opposite sides of the tool joints 52 (e.g., threaded connection). More specifically, the first belt drive system 200 may be configured to receive an upper joint of tubular 38, and the second belt drive system 202 may be configured to receive a lower joint of tubular 38.

The first and second belt drive systems 200 and 202 further include respective hydraulic pistons 206. The hydraulic pistons 206 are configured to actuate and clamp the first and second belt drive systems 200 and 202 about the respective joints of tubular 38 when the joints of tubular 38 are positioned in the respective openings 204 of the first and second belt drive systems 200 and 202. In this manner, the first and second belt drive systems 200 and 202 may grip the joints of tubular 38, thereby enabling more efficient transfer of torque from one joints of tubular 38 to another. Additionally, the openings 204 in the first and second belt drive systems 200 and 202 enable the joint rotation system 50 to be laterally engaged with the joints of tubular 38. That is, the joint rotation system 50 does not need to be axially "threaded" or disposed about the joints of tubular 38.

Figure 7:
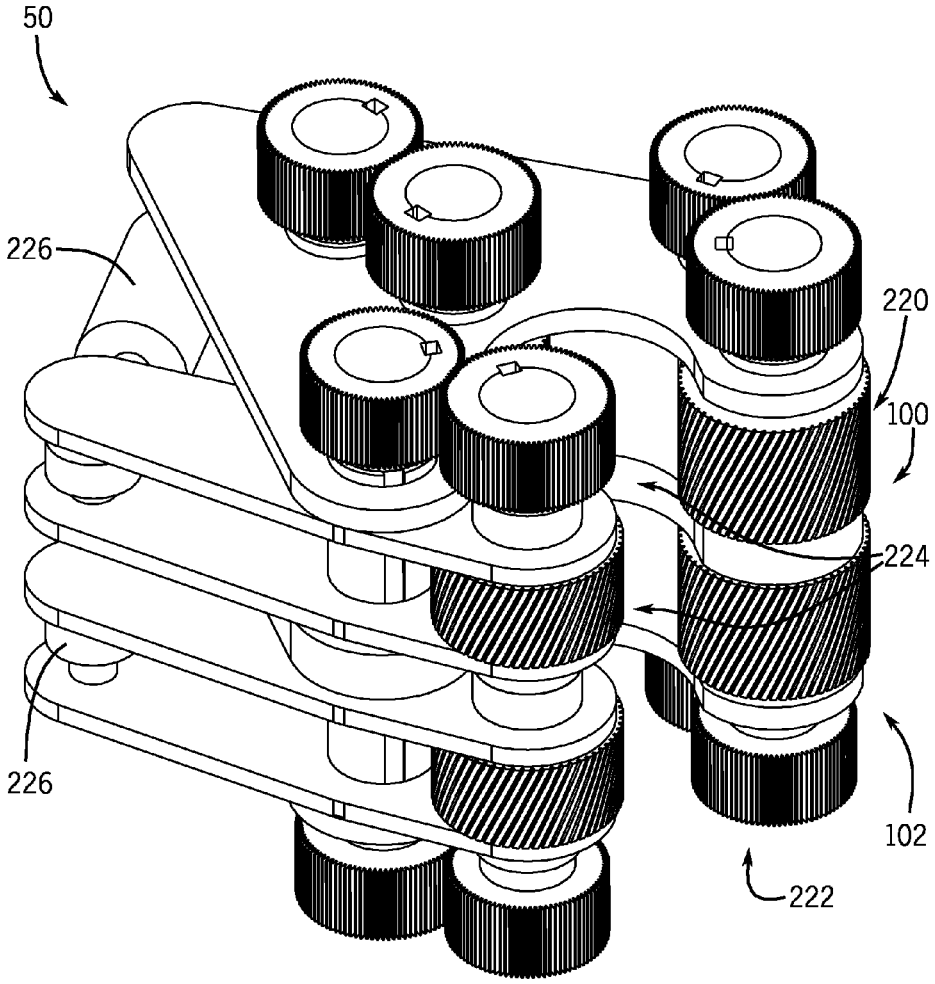
FIG. 7 is a perspective view of a joint rotation system, in accordance with present techniques.

FIG. 7 is a perspective view of the joint rotation system 50 where the first and second clamping mechanisms 100 and 102 include knurled rollers. More specifically, the first clamping mechanism 100 includes a first set 220 of knurled rollers, and the second clamping mechanism 102 includes a second set 222 of knurled rollers. As similarly discussed above with respect to FIG. 6, the first and second sets of knurled rollers 220 and 222 have openings 224, which are configured to receive respective joints of tubular 38 on opposite sides of the tool joints 52 (e.g., threaded connection). More specifically, the first set of knurled rollers 220 may be configured to receive an upper joint of tubular 38, and the second set of knurled rollers 222 may be configured to receive a lower joint of tubular 38.

The first and second clamping mechanisms further include respective hydraulic pistons 266. The hydraulic pistons 226 are configured to actuate and clamp the first and second sets of knurled rollers 220 and 222 about the respective joints of tubular 38 when the joints of tubular 38 are positioned in the respective openings 224 of the first and second sets of knurled rollers 220 and 222. In this manner, the first and second sets of knurled rollers 220 and 222 may grip the joints of tubular 38, thereby enabling more efficient transfer of torque from one joint of tubular 38 to another. Additionally, the openings 224 in the first and second sets of knurled rollers 220 and 222 enable the joint rotation system 50 to be laterally engaged with the joints of tubular 38. That is, the joint rotation system 50 does not need to be axially "threaded" or disposed about the joints of tubular 38.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a first grip configured to couple to a first tubular;

a second grip configured to couple to a second tubular, where the first and second tubulars are connected by a threaded connection; and a coupling mechanism coupling the first and second grips, the coupling mechanism comprising a gear assembly, wherein the gear assembly comprises a first gear and a second gear, the first grip is configured to drive the first gear, the first gear is configured to drive the second gear, the second gear is configured to drive the second grip, and the gear assembly has a speed ratio greater than 1.

2. The system of claim 1, wherein the first grip and the first gear are coupled by a first chain, and the second gear and the second grip are coupled by a second chain.

3. The system of claim 1, wherein the first grip comprises a first hydraulic clamp, and the second grip comprises a second hydraulic clamp.

4. The system of claim 1, wherein the second grip comprises a power slip comprising a rotational locking mechanism.

5. The system of claim 1, wherein the first grip comprises a first belt assembly, and the second grip comprises a second belt assembly.

6. The system of claim 1, wherein the first grip comprises a first set of knurled rollers, and the second grip comprises a second set of knurled rollers.

7. The system of claim 1, wherein the first tubular is positioned above the second tubular.

8. The system of claim 1, comprising a top drive configured to drive rotation of the first tubular in a clockwise direction.

9. A system, comprising:

a joint rotation system, comprising:

a first clamping mechanism configured to clamp to a first pipe;

a second clamping mechanism configured to clamp to a second pipe, wherein the first and second pipes are coupled by a threaded connection;

a first gear configured to be driven by rotation of the first clamping mechanism; and a second gear fixedly attached to the first gear, wherein a speed ratio of the first and second gears is greater than one, and the second gear is configured to drive rotation of the second clamping mechanism.

10. The system of claim 9, comprising a top drive configured to drive rotation of the first pipe.

11. The system of claim 9, wherein the first clamping mechanism and the second clamping mechanism are configured to be operated separately.

12. The system of claim 9, wherein the first clamping mechanism comprises a first hydraulic clamp, and the second clamping mechanism comprises a second hydraulic clamp.

13. The system of claim 9, wherein the first gear is coupled to the first clamping mechanism by a first chain drive, and the second gear is coupled to the second clamping mechanism by a second chain drive.

14. The system of claim 9, wherein the first clamping mechanism comprises a first belt drive, and the second clamping mechanism comprises a second belt drive.

15. The system of claim 9, wherein the first clamping mechanism comprises a first set of knurled rollers, and the second clamping mechanism comprises a second set of knurled rollers.

16. A method, comprising:

rotating a first tubular at a first angular velocity with a top drive;

transferring a torque from the first tubular to a second tubular via a coupling mechanism, wherein the coupling mechanism comprises a first clamping mechanism coupled to the first tubular, a first gear configured to be driven by rotation of the first clamping mechanism, a second gear fixedly attached to the first gear, and a second clamping mechanism configured to be driven by rotation of the second gear;

rotating the second tubular at a second angular velocity with the second clamping mechanism coupled to the second tubular, wherein the first tubular is coupled to the second tubular by a threaded connection, and the second angular velocity is greater than the first angular velocity.

17. The method of claim 16, wherein rotating the first tubular at the first angular velocity with the top drive comprises rotating the first tubular in a clockwise direction.

* * * * *